United States Patent [19]

Rago

[11] 4,139,062

[45] Feb. 13, 1979

[54] TELESCOPIC AUTOMATIC FIRE EXTINGUISHER

[76] Inventor: John J. Rago, 31 Avenue Charles de Gaulle, 95160 Montmorency, France

[21] Appl. No.: 733,274

[22] Filed: Oct. 18, 1976

[30] Foreign Application Priority Data

Oct. 27, 1975 [FR] France ..... 75 32763

[51] Int. Cl.[2] ..... A62C 37/12

[52] U.S. Cl. ..... 169/37

[58] Field of Search ..... 169/37, 38, 41, 17, 169/40, 16

[56] References Cited

U.S. PATENT DOCUMENTS

| | | | |
|---|---|---|---|
| 2,389,331 | 11/1945 | Tyden | 169/37 |
| 2,389,332 | 11/1945 | Tyden | 169/37 |
| 2,568,429 | 9/1951 | Burnam et al. | 169/38 X |
| 3,039,536 | 6/1962 | Moore et al. | 169/37 |
| 3,198,258 | 8/1965 | Werner | 169/19 |
| 3,584,689 | 6/1971 | Willms | 169/38X |
| 3,714,989 | 2/1973 | Gloeckler | 169/19 |

*Primary Examiner*—Joseph F. Peters, Jr.
*Assistant Examiner*—Michael Mar
*Attorney, Agent, or Firm*—Brisebois & Kruger

[57] ABSTRACT

Telescopic automatic fire extinguisher comprises a stationary first part adapted to be permanently connected to a water supply, and a second part which is telescopically seated in the first and retained in a recessed position by a connection in the form of a low melting point solder until the solder is heated, whereupon the connection is broken and the movable part is extended while simultaneously opening a passage for water through both parts.

8 Claims, 4 Drawing Figures

TELESCOPIC AUTOMATIC FIRE EXTINGUISHER

SUMMARY OF THE INVENTION

This invention relates to automatic extinguishers or sprinklers which automatically spray the zones under their protection in the case of an abnormal local increase in temperature.

The known automatic extinguishers consist of a head connected to a water supply pipe and comprising a spout through which the jet of water gushes, and a deflector fixed to said spout and positioned in the trajectory of the jet in order to insure the division and distribution of the water, a glass bulb being positioned between the deflector and the opening in the spout so as to normally block the latter, but permit the passage of water when the glass bulb is broken by expansion of a liquid which it contains.

The prinicipal disadvantage of these extinguishers, which are almost always positioned in the ceiling of the places they are to protect, is that they are bulky and unattractive. In effect, in most large public places, such as large stores, it is customary to conceal all the utility lines behind a decorative false ceiling, but it is not possible to conceal the heads of automatic extinguishers, especially their stationary deflectors which necessarily project beneath the ceiling, since if they did not they would be unable to adequately divide and distribute the water.

The purpose of the invention is specifically to provide an automatic extinguisher of the above type which may be embedded inside the false ceiling without projecting beneath the ceiling but which nevertheless acts efficaciously in the case of fire.

The invention consists in combining a stationary head connected to the water supply line and a member which is axially movable inside or outside the stationary head, along a limited path, said member comprising a sliding cylindrical part serving both as a plug and as a spout for forming an axial jet, and a terminal part serving as a deflector and held in position at the end of the head, which is itself held at the level of the false ceiling by retaining means sensitive to temperature, such as a solder having a low melting point, so that the release of the deflector results in axial telescopic displacement of the movable member, which simultaneously results in supplying it with a jet of water and positioning the deflector at a suitable distance beneath the false ceiling so that it may serve its purpose. The axial pressure on the movable member may be produced by a spring or by water pressure. On the other hand, the plug may advantageously consist of a cylindrical slide valve lined with a thin plastic sealing jacket which bursts in response to the pressure of the water.

Other particular features of the invention will appear from the following description of several embodiments thereof given, purely by way of example, and illustrated on the accompanying drawing, in which.

Figure 1:
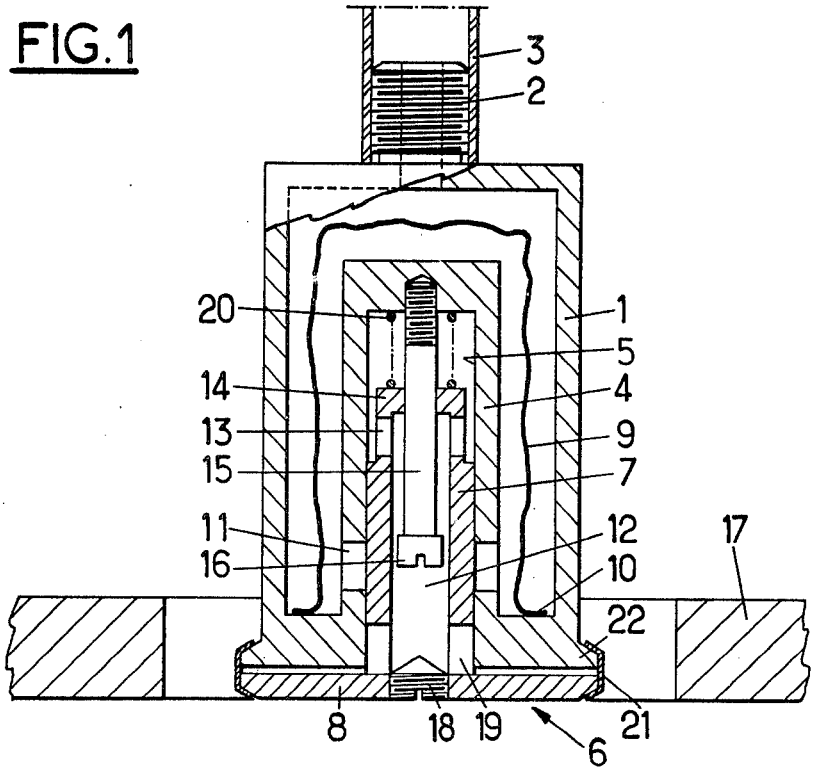
FIG. 1 is an axial sectional view through a first embodiment in which axial pressure is provided by a spring.

The device shown in FIG. 1 comprises a head 1 terminating at its upper end in a threaded spigot 2 which permits it to be connected in a conventional manner to a water supply pipe 3. The head 1 encloses a second wall 4 shaped like the finger of a glove and in which a bore 5 is machined.

The device also comprises a movable member 6 having a cylindrical part 7 having diameter which enables it to fit slidably but closely inside the bore 5, and a flat end 8 forming a deflector of the usual type, that is to say, more or less concave and generally provided with radial slots.

In order to insure blocking of the water under pressure contained between the two walls 1 and 4, the precision of adjustment between the cylindrical parts 7 and the bore 5 may suffice. Nevertheless, for safety, it is preferable in accordance with the invention to add a thin plastic envelope 9, which entirely covers the part 4 resembling the finger of a glove, and which is sealed to its base 10 either against the flat bottom, or against the cylindrical wall 4, by appropriate means such as adhesives.

Alternatively, when the part 4 is made of a molded plastic material, it is also possible to leave, during molding, thin diaphragms at the bottom of the holes 11. Another alternative consists in making the diaphragms by injection of a plastic material.

Several holes 11 for the passage of water are pierced in the wall 4 near its base and normally blocked by the cylindrical part 7. The pressure of the water plasters the thin plastic diaphragm 9 against the external surface of the wall 4 and against the inside of the holes 11 so that it bears against the cylindrical part 7. When this cylindrical part 7 moves axially so as to uncover the holes 11 this support is eliminated, and the pressure of the water serves to burst the diaphragm in the bottom of the holes 11, which permits the passage of water. This water then supplies the axial passage 12 provided in the cylindrical part 7 through holes 13 pierced in the cylindrical upper part 14, which has a diameter clearly smaller than that of the bore 5. This is in order to avoid having to exactly position the holes 13 opposite the holes 11.

In order to limit the axial path of travel of the movable assembly 6, internal means such as shown in the example illustrated in FIG. 1 may be used. This consists of a simple screw 15 which passes freely through the end 14 and is then screwed into the upper end of the part 4 of the head 1, the head 16 of this screw being so positioned that, when the upper end of the axial passage 12 comes into abutment against it, the upper end of the cylindrical part 7 completely uncovers the holes 11, and the deflector 8 is caused to project below the false ceiling 17 by a distance sufficient to avoid inhibiting the distribution of water. The closure plug 18 is used to close the entrance to the axial passage 12 after the movable assembly has been mounted. This passage is nevertheless laterally open above the deflector 8 through orifices 19. The axial pressure necessary to displace the plug and the deflector is furnished by a spring 20 positioned between the parts 4 and 14 around the screw 15. Finally the deflector 8 is retained by means of an annular member 21 formed from a thin strip of metal, brass for example, rolled into a ring having overlapping ends which are soldered to each other with a solder having a low melting point which is of a known type. This annular member then covers the peripheral edge of the deflector 8 and an edge 22 which is carried by the base of the head 1.

Figure 2:
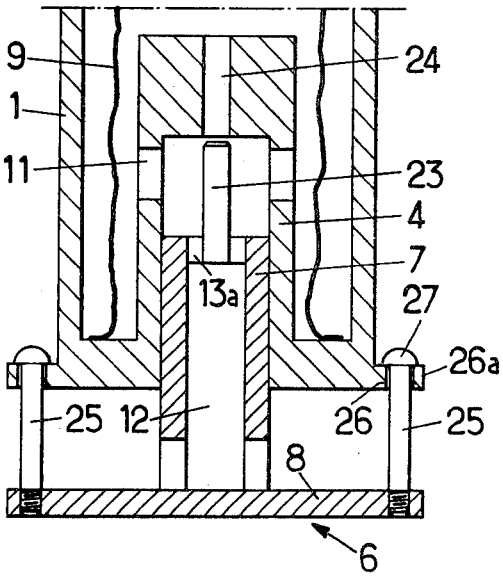
FIG. 2 is a partial axial section through an embodiment in which axial pressure is provided hydraulically.
Figure 3:
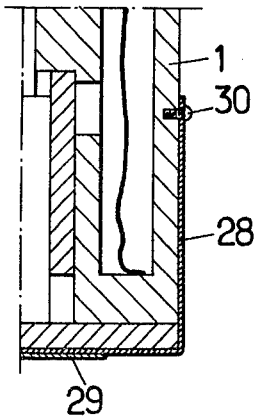
FIG. 3 is a partial axial section corresponding to FIG. 2 but taken in a plane perpendicular thereto and showing a modification of the retaining means.

As an alternative, as in the example illustrated on FIGS. 2 and 3 the axial pressure, instead of being supplied by a spring 20, may be furnished by hydraulic pressure by extending the cylindrical part 7 to form a cylindrical pin 23 which slides as a close fit in a bore 24 formed in the upper end of the inner member 4. In rest position the end of the pin 23 is preferably flush with the upper end of the bore 24, the assembly being blocked by the thin plastic envelope 9 which covers the holes 11, but which bursts in response to the water pressure when the apparatus begins to operate. Naturally the section of the pin 23 and the bore 24 in which it slides are chosen to have a value appropriate to obtain the desired axial pressure, taking into account the pressure of the water supply.

The water passes from the orifices 11, once uncovered by the cylindrical part 7, to the axial passage 12, through axial holes 13*a* surrounding the base of the pin 23.

In this case the axial path of travel of the movable assembly 6 may advantageously be limited by means of an external device consisting for example of two screws 25 fixed in the deflector 8 at points diametrically opposite each other and sliding in orifices 26 formed in the ears 26*a* at the base of the head 1. These screws 25 comprise a head 27 which bears against the ears 26*a* to limit the path of travel.

In order to retain the member 8 in place, one may use any other appropriate means, for example two metallic strips 28 and 29 the lower ends of which overlap and are soldered as above with a solder having a low melting point and the upper ends of which are attached to the head 1 by any suitable means such as screws 30.

Figure 4:
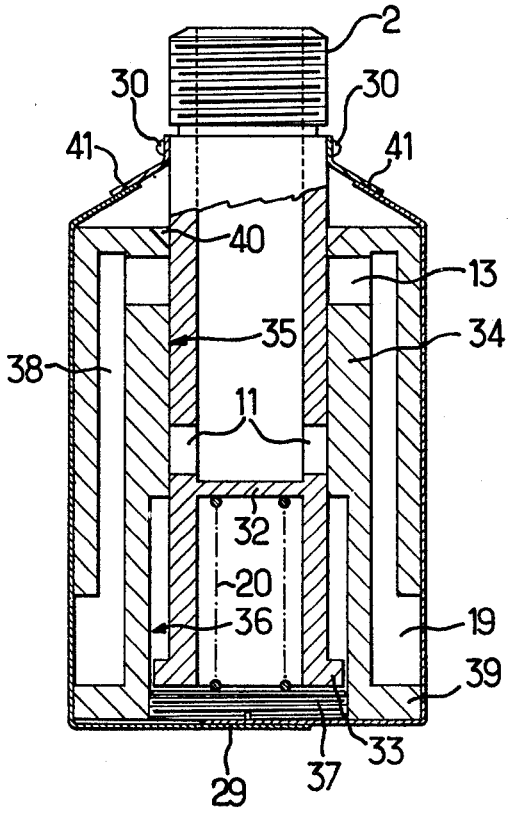
FIG. 4 is a partial axial section through another embodiment having an external sliding member.

As an alternative, instead of making the plug 7 slidable inside the stationary head, one may, as illustrated in FIG. 4, cause this plug to be slidable outside the stationary head.

The head is then reduced to a simple cylindrical member 31 having a median partition 32 just beneath the orifices 11, a threaded spigot 2 at one end, and an abutment collar 33 at the other end. It is the movable outer part 34 which has an upper bore 35, with flow holes 13, and a larger lower bore 36 in which the collar 33 slides. The spring 20 is seated beneath the partition 32 and bears against a plug 37 closing the bore 36.

The jet is formed in the space 38 between the two concentric walls of the movable member 34 and the deflector is still constituted by the lower part 39 of this movable member.

Optionally, slots 40 may be provided at the upper end where the bore 35 opens so as to disperse a fraction of the flow above the false ceiling in order to avoid any risk of fire in this zone.

In this case it is preferable to provide a double acting fusible member for detecting the elevation of temperature in both the two zones to be protected. For this purpose the strips of FIG. 3 may be modified in the manner shown on FIG. 4 by providing, in addition to the lower soldered joint 29, two upper soldered joints 41, positioned in the zone above the ceiling. In this manner, the melting of any one of the three soldered joints results in release of the plug.

The invention therefore provides automatic extinguishers no part of which projects below the false ceiling 17. The flat deflectors 8 come just flush with this ceiling, with which they are aligned, and may be painted, without disadvantage, the same color, whereas in the case of trouble, once the low melting point solder has melted, the corresponding deflectors 8 are immediately positioned at the right height to carry out their function due to the telescopic displacement of the plug.

On the other hand, contrary to conventional automatic extinguishers, each of the automatic extinguishers according to the invention may be easily blocked individually after trouble by simple depression, after which the insertion of supplementary provisional retaining means makes it possible to limit the distribution of water. On the other hand, thanks to the presence of the diaphragm 9 of thin plastic material, it is possible to demount the blocking plug and withdraw it for inspection after interruption of the pressure of the water in the supply passages without having to empty the installation, contrary to what is the case with conventional devices.

What is claimed is:

1. Automatic telescopic fire extinguisher comprising:
a water distributing head adapted to be connected to a stationary position to a water supply duct,
a movable member slidably mounted on said head for movement between a first position in which it prevents distribution of water by said head and a second position in which it permits said distribution and deflects water leaving said head,
single means for applying pressure urging said movable member to its second position, and
temperature responsive means for retaining said movable member in its first position until, but only until, said temperature-responsive means is subjected to as least a predetermined temperature, and in which said head comprises a first cylindrical portion, and said movable member comprises a coaxial second cylindrical portion telescopically slidable with respect to said first cylindrical portion, both cylindrical portions have transverse apertures which are blocked when said movable member is in said first position, said apertures comprising valve means for controlling the entire flow of water through the head, each of said apertures of said first cylindrical portion being sealed by said second cylindrical portion, in said first position.

2. Automatic fire extinguisher as claimed in claim 1 in which, when said movable member is in said second position said cylindrical portions define therebetween a clearance permitting water to escape from said head above said movable member.

3. Automatic fire extinguisher as claimed in claim 1 in which said single means for applying pressure to said movable member comprises a piston rod which, when said movable member is in said first position, projects into a cylinder in said stationary member communicating with said supply duct, so that said piston rod is subjected to the pressure in said supply duct.

4. Extinguisher as claimed in claim 1 comprising a film of plastic material blocking the transverse apertures in said head when said movable member is in said first position, said film being so thin as to burst when subjected to water pressure when said movable member is in said second position.

5. Extinguisher as claimed in claim 1 wherein said single means for applying pressure comprises spring means biasing said movable member toward said second position.

6. Extinguisher as claimed in claim 1 in which said temperature responsive means is a ring of high temperature melting material holding adjacent edges of said head and movable member together and fastened by means of a solder having a low melting point.

7. Extinguisher as claimed in claim 1 in which said temperature responsive means comprises two strips attached at one end to said head and at their other ends to each other beneath said movable member.

8. Extinguisher as claimed in claim 1 comprising two temperature responsive means, one near the lower end and one near the upper end of said movable member.

* * * * *